US007004412B2

(12) United States Patent
Olson

(10) Patent No.: US 7,004,412 B2
(45) Date of Patent: Feb. 28, 2006

(54) MICRON HAMMERMILL

(75) Inventor: Jerry R. Olson, Maplewood, MN (US)

(73) Assignee: Carter Day International, Inc., Minneapolis, MN (US)

( * ) Notice: Subject to any disclaimer, the term of this patent is extended or adjusted under 35 U.S.C. 154(b) by 167 days.

(21) Appl. No.: 10/717,790

(22) Filed: Nov. 20, 2003

(65) Prior Publication Data

US 2005/0109864 A1 May 26, 2005

(51) Int. Cl.
*B02C 13/282* (2006.01)

(52) U.S. Cl. ..... 241/188.1

(58) Field of Classification Search ..... 241/188.1, 241/188.2, 189.1

See application file for complete search history.

(56) References Cited

U.S. PATENT DOCUMENTS

| | | | | |
|---|---|---|---|---|
| 1,185,620 | A | 6/1916 | Blum | |
| 2,640,650 | A | 6/1953 | Jacobson | |
| 2,785,865 | A | 3/1957 | Berling | |
| 2,803,634 | A | 8/1957 | Chayen | |
| 3,143,303 | A | 8/1964 | Palyi | |
| 3,170,640 | A | 2/1965 | Kolts et al. | |
| 3,279,707 | A | 10/1966 | Jacobson | |
| 3,554,454 | A * | 1/1971 | Gruendler | 241/73 |
| 3,825,194 | A | 7/1974 | Buell | |
| 3,966,126 | A | 6/1976 | Werner | |
| 4,243,182 | A | 1/1981 | Dugger, Jr. | |
| 4,650,127 | A | 3/1987 | Radwanski et al. | |
| 4,875,630 | A | 10/1989 | Carlson | |
| 5,421,528 | A | 6/1995 | Ronning | |
| 5,794,865 | A | 8/1998 | Didion et al. | |
| 6,637,682 | B1 * | 10/2003 | Akiyama et al. | 241/97 |
| 2001/0045478 | A1 | 11/2001 | Recker et al. | |

* cited by examiner

*Primary Examiner*—Mark Rosenbaum
(74) *Attorney, Agent, or Firm*—Fredrikson & Bryon, P.A.

(57) ABSTRACT

An improved design for hammermills. The invention contains a centered rotor from which eight rows of hammers pulverize material against cutting plates inside a working chamber. The cutting plates have slots that are angled. The hammers may have a beveled, angled leading edge. Both the angled cutting plate slots and the angled hammer leading edges work to drive the material through the working chamber in a helical fashion, with a preferred travel profile of 450 degrees, but the helix length is adjustable depending on the specific needs. There are no perforated screens in the hammermill, thus the material is placed in an inlet, is urged through the hammermill by the action of the rotating hammers where the material is comminuted and then removed via an exit. The communitive efficiency and particle size may be affected by the following adjustable elements: The clearance distance between the hammer tips and the cutting plate; the degree of angle of the cutting plate slots, the degree of angle of the hammers' leading edges; the density and pattern of the cutting plate slots; the speed of rotation of the hammers; and the length of helical travel of the material within the working chamber. The invention further provides a discharge assist by allowing one set of hammers to be non-beveled so that the material is swept along. A second discharge assist embodiment provides that the last section of the helix is smooth to increase the particle speed at the outlet.

17 Claims, 4 Drawing Sheets

MICRON HAMMERMILL

FIELD OF THE INVENTION

This invention relates generally to hammermills.

BACKGROUND OF THE PRESENT INVENTION

Hammermills have long been used for grinding or comminution of materials. Typically hammermills consist of a rotor mounted on a solid through rotor shaft inside a housing. A material inlet is generally located at the top of the housing with one or more material outlets located near the bottom of the housing. The rotor includes a solid through drive shaft and rows of hammers which are normally flat steel blades or bars. A steel rod or pin pivotably connects the hammer to the rotor. The rotor is mounted inside a typically teardrop shaped enclosure, commonly known as a grinding or working chamber, which is comprised of a cutting plate mounted on either side of the material inlet for reversible hammermills. Reversible hammermills are capable of rotation in either direction, a feature which provides for increased life for the hammers, cutting plates and screen plates. The known cutting plates are comprised of a upper linear section connected with a convex radiused section and do not allow particles to escape.

Downstream of the cutting plate, the interior of the working chamber is defined by curved screen plates. The screen opening diameter is selected to match the desired particle size. Generally, material at or below an intended size limit exit the chamber through the screens while material above the size limit continue to be reduced by the rotating hammers.

Current hammermill rotor designs consist of a solid through rotor shaft which supports a number of cylindrical head disks. The head disks are keyed to the shaft and are spaced along the shaft with ring type spacers, often squeeze collars or the equivalent are employed. The head disks and spacers are held together on the rotor shaft by using bearing locknuts which are positioned on the threaded ends of the rotor shaft. These nuts are then tightened to take the clearance out between the disks and the spacers.

The disks structurally support a number of hammer pins radially around the solid rotor shaft. The swinging hammers are mounted on the hammer pins. The disks structurally support the hammer pins from the centrifugal forces generated by the rotation of the rotor which typically rotates over a range of 1200 to 3600 rpm. The disks also transmit the torque from the rotor shaft to the hammer pins; required to power the hammers through their impact against the product being processed in the hammermill.

In operation, the material to be reduced is fed into the material inlet and is directed toward the rotating hammers. The material is initially impacted by the hammers, which may cause some material reduction. The material is then flung from the hammer face against the cutting plates resulting in a primary reduction of material. After the material impacts the cutting plate, from which there is typically no outlet, the material is either flung back toward the rotating hammers or continues downstream between the hammer tip and the cutting plate until the screen plates are reached.

Ultimately, the particles encounter the openings of the screen plates. Here, the particles that are small enough begin to exit through the screen openings. The remaining particles impact the leading edge of the screen openings and are deflected up into the hammers' path. The rotating hammers continue to pulverize the material downstream of the cutting plate, moving it along the surface of the screens which define the circumference of the working chamber, causing gradual diminution of the material. Ultimately, the material is ground finely enough to permit it to flow out through the screens.

Pulverizers work generally in the same manner as hammermills except that non-swinging knives are used in place of the swinging hammers. This configuration allows for a finer particle size than the typical hammermill, but results in greater wear damage to the rigid knives.

While the hammermill and pulverizer designs as described above have been generally accepted and is widely used, there is a constant need and desire to achieve a finer particle size without the associated wear and stress encountered in known designs.

The present invention accomplishes these goals.

SUMMARY OF THE INVENTION

An improved design for hammermills. The invention contains a centered rotor from which any number of rows of hammers, typically 4–8, pulverize material against cutting plates inside a working chamber. The cutting plates have slots that are angled. The hammers may have a beveled, angled leading edge. Both the angled cutting plate slots and the angled hammer leading edges work to drive the material through the working chamber in a helical fashion, with a preferred travel profile of 450 degrees, but the helix length is adjustable depending on the specific needs. There are no perforated screens in the hammermill, thus the material is placed in an inlet, is urged through the hammermill by the action of the rotating hammers where the material is comminuted and then removed via an exit. The communitive efficiency and particle size may be affected by the following adjustable elements: The clearance distance between the hammer tips and the cutting plate; the degree of angle of the cutting plate slots, the degree of angle of the hammers' leading edges; the density and pattern of the cutting plate slots; the speed of rotation of the hammers; and the length of helical travel of the material within the working chamber. The invention further provides a discharge assist by allowing one set of hammers to be non-beveled so that the material is swept along. A second discharge assist embodiment provides that the last section of the helix is smooth to increase the particle speed at the outlet.

An object and advantage of the invention is to provide a hammermill with the ability to produce finer particle size than previously possible.

Another object and advantage of the invention is to provide a hammermill that can produce suitably fine particles with reduced wear to the device.

Another object and advantage of the invention is to provide a hammermill with no perforated screens and with cutting plates that have angled slots to increase the communitive efficiency.

Another object and advantage of the invention is to provide a hammermill with angled hammer tips to increase the communitive efficiency.

Yet another object and advantage of the invention is to provide a hammermill with customizable communitive efficiency.

The foregoing objects and advantages of the invention will become apparent to those skilled in the art when the following detailed description of the invention is read in conjunction with the accompanying drawings and claims. Throughout the drawings, like numerals refer to similar or identical parts.

DETAILED DESCRIPTION OF THE INVENTION

With reference to the accompanying Figures, which provide one embodiment of the invention, there is provided a micron hammermill capable of very fine grinding of particles. The inventive hammermill achieves the fine particle size of a pulverizer but with the flexibility of swinging hammers, as opposed to rigid knives.

Figure 1:
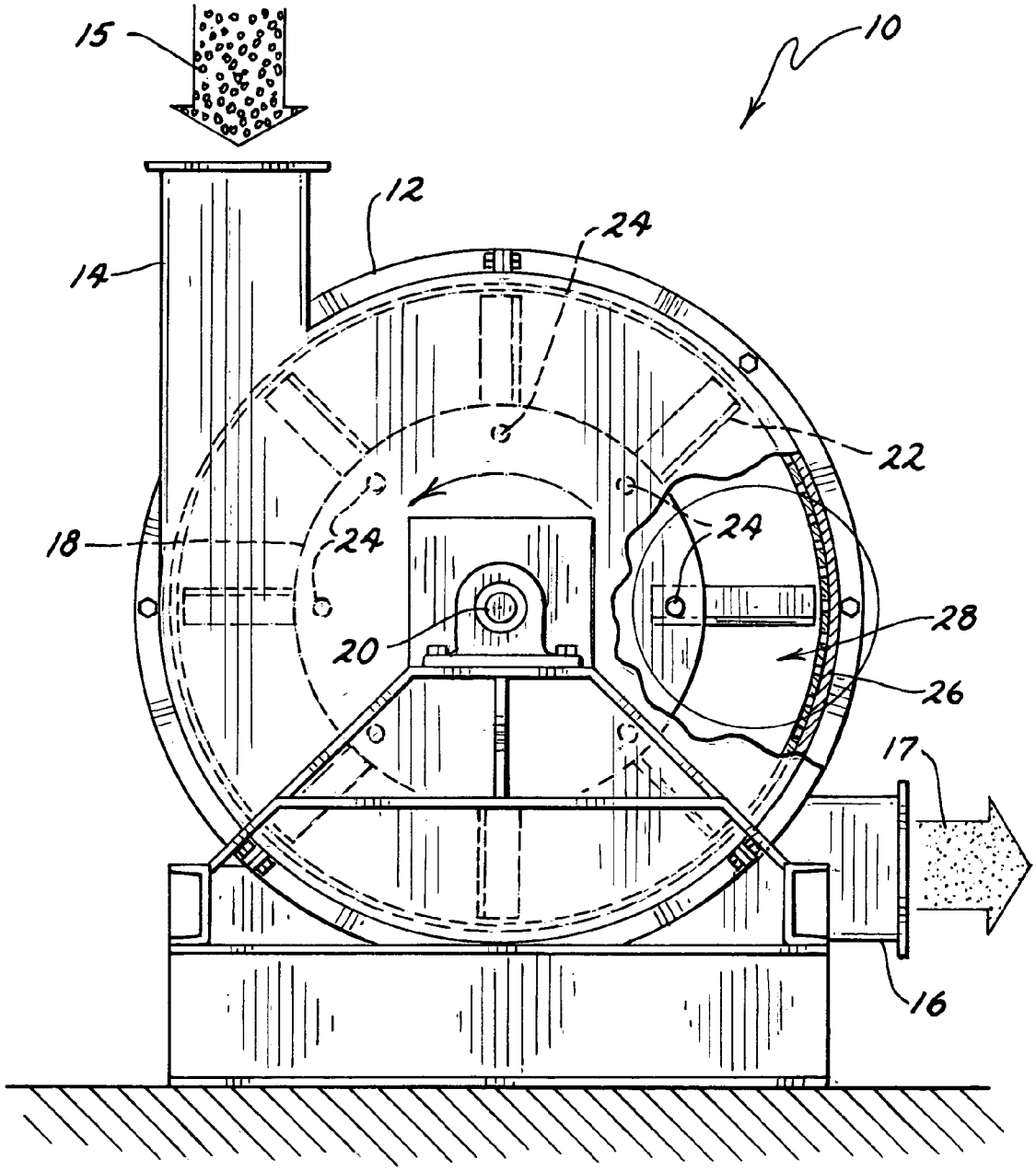
FIG. 1 is a cross-sectional side view of the micron hammermill with a cutaway into the working chamber.

Referring to FIG. 1, the hammermill 10 is shown in cross section. The hammermill 10 includes a housing 12, preferably made of metal, with a material inlet 14 located through the top of the housing and a ground particle discharge outlet 16 at the bottom of the housing 12. There is further provided a rotor 18 that is mounted on a driven shaft 20 that rotates about an axis of rotation. Hammers 22 are pivotably mounted with pins 24 in rows on the rotor 18.

Figure 2:
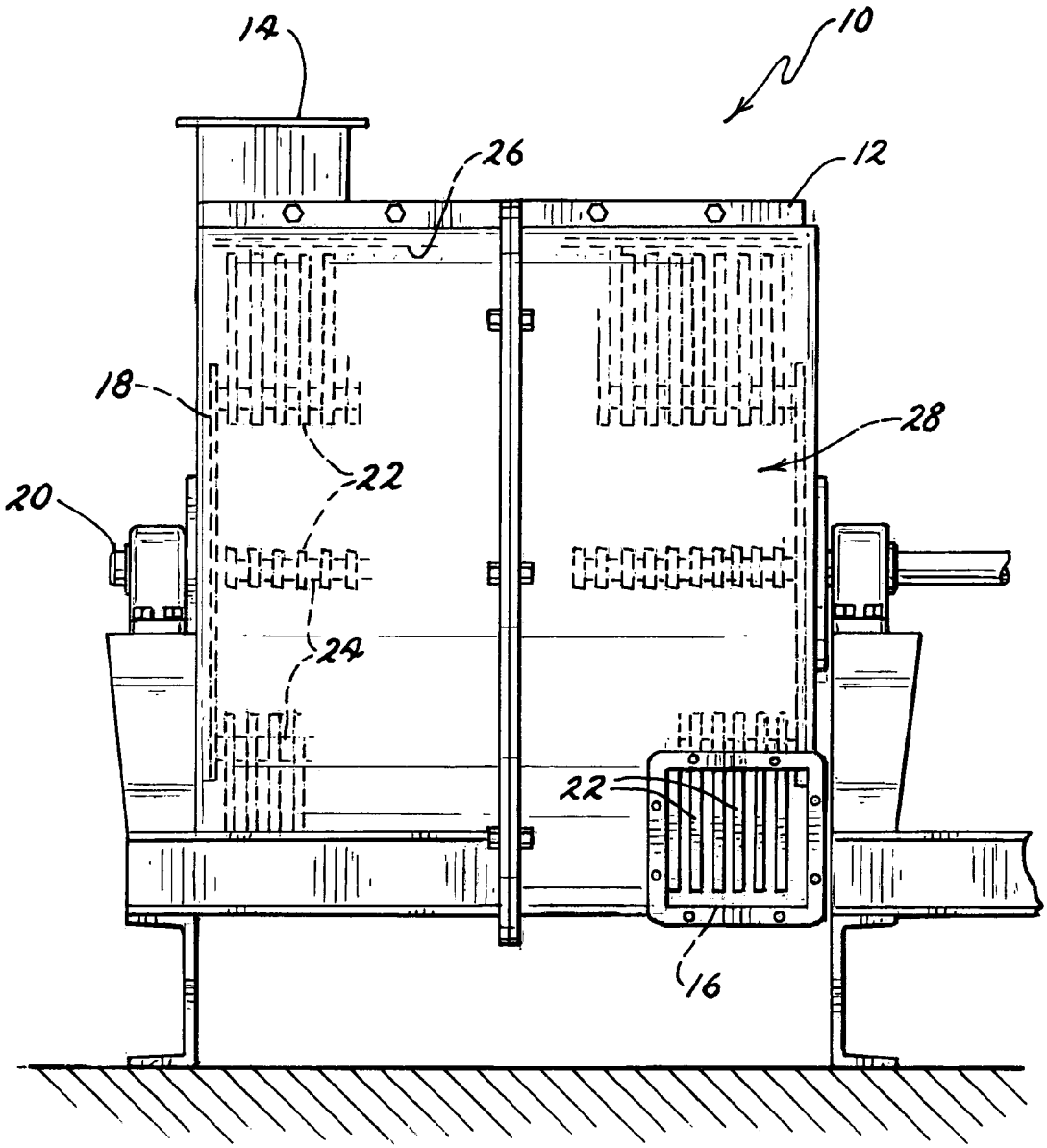
FIG. 2 is a front cross-sectional view.

Downstream of the inlet 14, that is, in the direction of hammer rotation and material flow, a cutting plate 26 is mounted adjacent the inlet 14. FIG. 2 provides a front cross-sectional view of the cutting plate 26. The cutting plate profile is generally cylindrical and is in adjacent communication with the inlet 14 and the discharge outlet 16.

Figure 3:
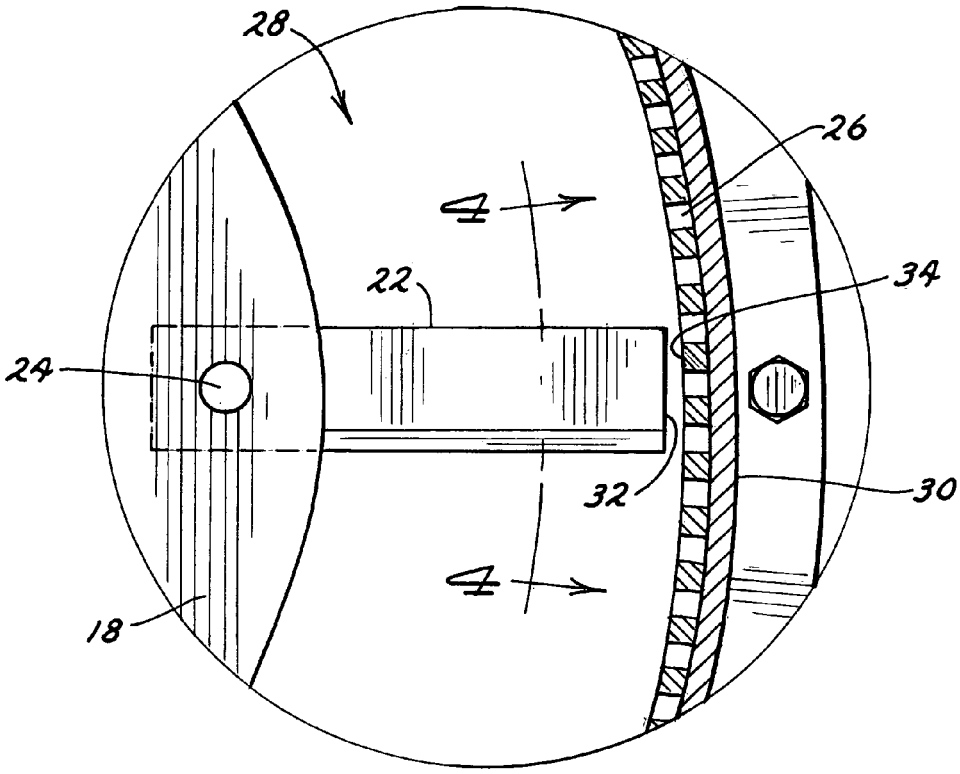
FIG. 3 is a cutaway view of a hammer and the cutting screen in the working chamber.
Figure 4:
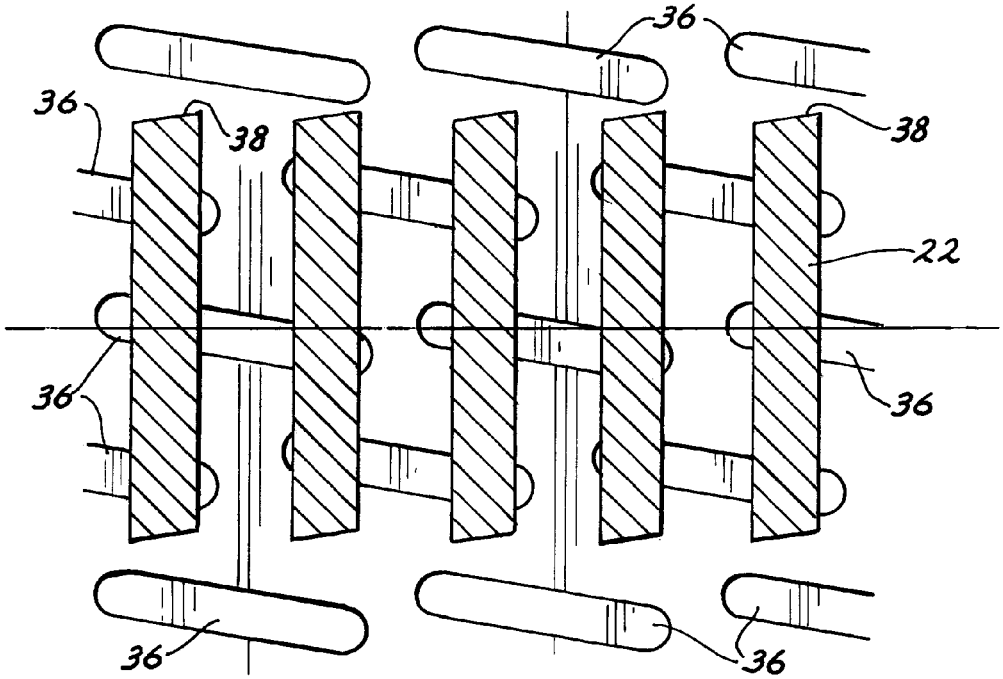
FIG. 4 is a cross-sectional view of the cutting plate and rotating hammer.

FIGS. 3 and 4 illustrate the relationship between the rotating hammers 22 and the cutting plate 26. The hammers 22 are illustrated in the Figures as rotating through a working chamber 28 in which the material is actually comminuted. The working chamber 28 is defined by the cylindrical cutting plate 26, the hammers 22 and the rotor 16.

With specific reference to FIG. 3, a clearance distance 30 between the hammer tip 32 and the surface 34 of the cutting plate is indicated. Further, FIG. 4 indicates that the cutting plate 26 comprises a plurality of slots 36 disposed therein. The slots 36 are preferably angled generally in the direction of the discharge outlet 16 to assist in moving the material being comminuted across the cutting plate 26 in a helical manner. The degree of angle directly affects the pitch of the helical movement of the comminuted material. A steeper angle in the cutting plate slots 36 creates a steeper helical pitch while a less step cutting plate slot angle results in a helical pitch that is correspondingly less steep.

The movement of the material through the working chamber 28 in a helical manner is also affected by the hammers 22 in the invention. The hammers 22 are further comprised of a leading edge 38. The leading edge 38 is preferably angled with approximately the same degree as the cutting plate slots 36, but in the opposite direction. This causes the material to impact the angled cutting plate slot 36 and be deflected into the pathway of the angled rotating hammer leading edge 38 which results in the material being deflected in the direction of the helical profile. The combination of the cutting plate slot angles and the angle of the leading edge of the hammer increases the grinding efficiency by achieving a greater degree of particle reduction while moving the material through the working chamber at a faster rate.

Alternate embodiments, not shown in the Figures, provide for adjustment of the clearance distance of the hammer tips 32 with the cutting plate surface 34, together with adjustment of the cutting plate slot angles and the hammer leading edge angle, as well as the general pattern and density of the cutting plate slots 36. A person reasonably skilled in the art will recognize the wide variety of possible permutations, and the relevance thereof, that the inventive device presents.

Figure 5:
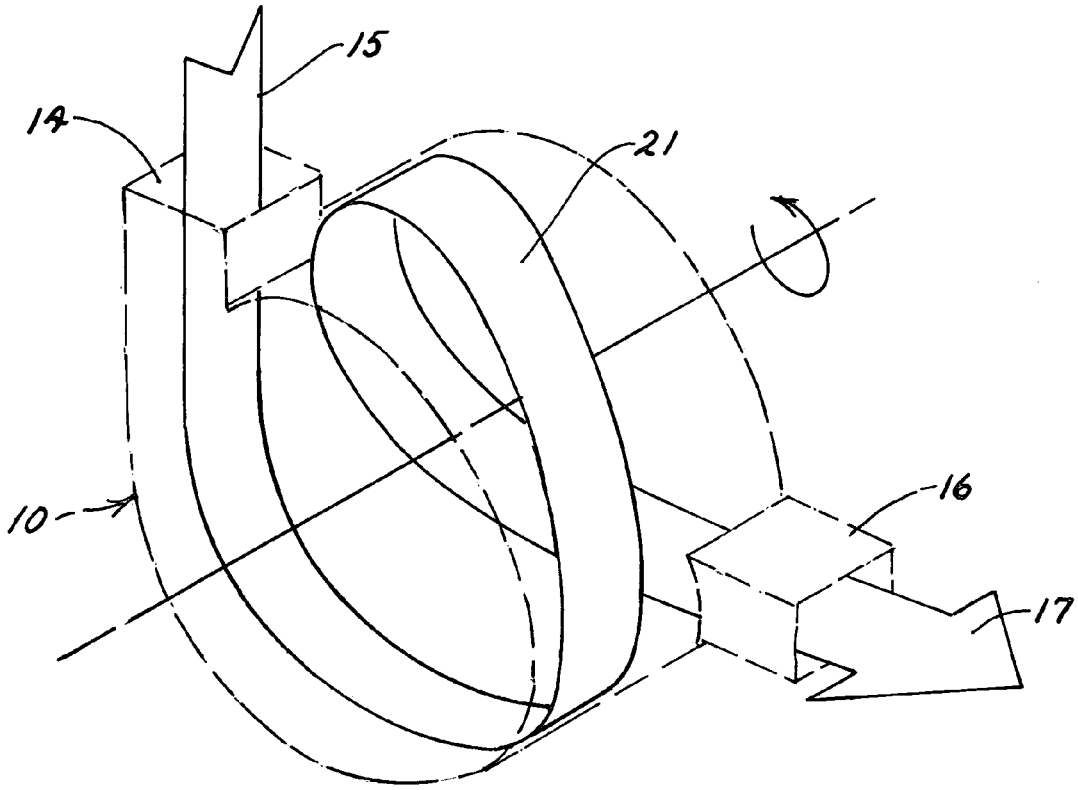
FIG. 5 is a schematic view of the helical working chamber.
Figure 6A:
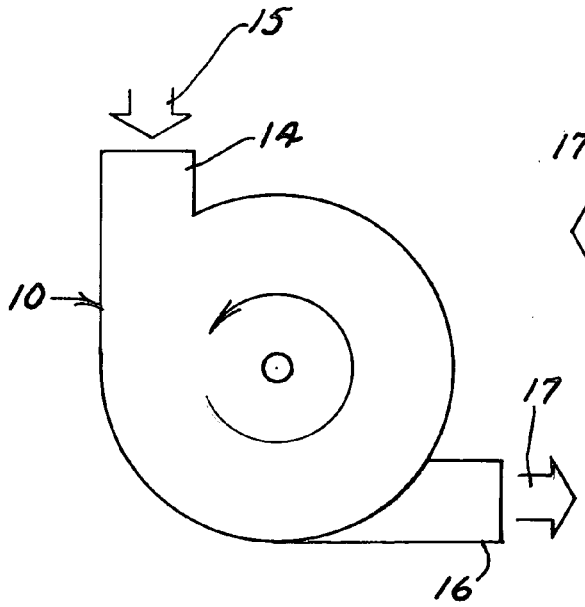
FIG. 6A is a side view of the micron hammermill configured with 450 degrees of particle travel.
Figure 6B:
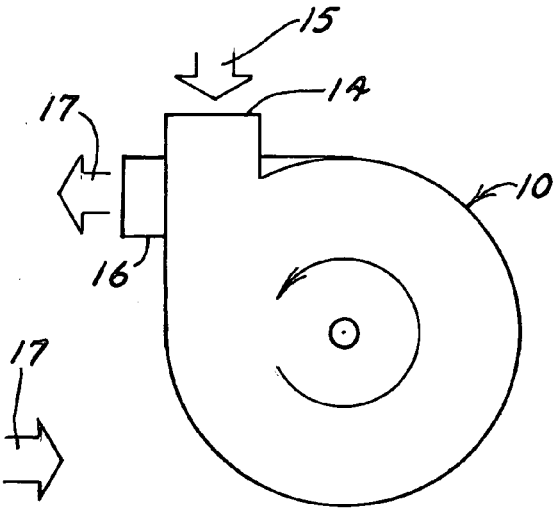
FIG. 6B is an alternate embodiment showing a side view of the micron hammermill configured with 270 degrees of particle travel.

Referring now to FIG. 5, the helical nature of the material flow is illustrated. Assuming a counterclockwise rotation of the hammers 22 as illustrated, the material under the present invention is urged in a helical manner and generally from left to right as the material enters the inventive hammermill at the inlet 14 and is discharged at the outlet 16. FIGS. 5 and 6A indicate a degree of travel length along the cutting plate 26 for the comminuted material within the working chamber 28 of approximately 450 degrees. This is the preferred travel length. However, the helical profile 21 may be less than 450 degrees or greater than 450 degrees depending on the particular requirements for the material being comminuted. FIG. 6B illustrates an alternate embodiment wherein the helix is profiled at approximately 270 degrees of material travel. To accommodate the helical movement of the material across the cutting plate 26, the discharge outlet 16 is offset longitudinally from the inlet 14 down the axis of rotation a certain distance. This offset is best illustrated in FIG. 5.

Generally, the degree of particle reduction is directly related to the length of residence time for the material in the working chamber 28 which, in turn, is directly related to the length of the helix that the material travels along. Thus, the longer the helix pathway 21, the longer the residence time for the material within the working chamber and the greater the particle reduction. The shorter the helix pathway 21, the less residence time for the material within the working chamber 28 and the particles are correspondingly more coarse.

The inventive hammermill 10 does not require perforated screens to control the finished particle size as in known hammermills. Instead, a host of adjustable elements allow control of both the finished particle size and the hammermill efficiency. Specifically, the pitch of cutting plate helical profile 21 used for a particular job is adjustable. The adjustability of the length of the helical profile 21 results from the adjustability of the cutting plate slot angle as well as the angle of the hammer leading edge 38. Generally, with decreasing helix pitch there is a concomitant increase in residence time for the comminuted material within the working chamber 28. This, in turn, results in a finer finished particle size. Alternatively, increasing the helix pitch results in a decreased residence for the material within the working chamber 28 and a coarser finished particle size.

The adjustability of the helix pitch may then combined with the other elements of the invention that may be adjusted as discussed above, namely, the clearance distance between the hammer tip 32 and the cutting plate surface 34, the density and pattern of the cutting plate slots 36 and the rotational speed of the hammers 22.

Alternate embodiments not shown in the Figures employ material discharge assist elements. One alternate embodiment has the last segment adjacent to the outlet 16 of the cutting plate 26 being substantially smooth or free of the cutting plate slots 36. This configuration more readily urges the comminuted material out of the working chamber 28 and ultimately out of the hammermill 10 via the discharge outlet 16. The material migrating over the last segment of the cutting plate 26 in this alternate embodiment is not subjected impact by cutting plate slots 36 and, as a result, is generally swept out of the hammermill 10 by the rotating hammers 22.

A second alternate embodiment provides for at least one row of hammers 22 to have leading edges 38 that are not angled, but are instead straight edged. This row of hammers 22 then works to sweep the material undergoing comminution through the working chamber 28 more efficiently, and ultimately, outward through the discharge outlet.

Operation of the preferred embodiment may now be described.

The operator first determines the proper setting for the adjustable parameters in order to achieve the desired balance between comminutive efficiency and the required degree of particle reduction. The angle of the cutting plate slots 36 and the hammer leading edge 38 angles must be specified in order to determine the desired material travel helical pathway 21 within the working chamber 28. The helix pitch parameter must then be balanced with the clearance distance between the hammer and the cutting plate surface, the density and pattern of the cutting plate slots and the rotational speed of the hammers to achieve the desired result.

Once the adjustable parameters are optimized, the material to be comminuted 15 is fed into the material inlet 14 of the hammermill 10. The fed material 15 exits the inlet 14 and enters the working chamber 28 where it is impacted by the rotating hammers 22 and flung against the cutting plate 26. The material impacts the cutting plate slots 36 which are angled generally toward the outlet 16 so that the material begins to be biased toward a generally helical profile. The material is then deflected from the angled cutting plate slot 36 upward into the path of the rotating hammers 22. The hammers comprise, in the preferred embodiment, leading edges 38 that are angled opposite the angle of the cutting plate slot 36. Further, in the preferred embodiment, the angle of the cutting plate slot 36 is matched with the opposite angle, but in the opposite direction, of the hammer leading edge 38. Thus, the hammer leading edge angle impacts the material deflected from the angled cutting plate slot 36, thus accelerating the material both in the direction of the rotating hammers 22 and also in the general direction of the cutting plate slot angles. Assuming counterclockwise rotation of the rotor and the hammers as indicated in FIG. 1, the material moves generally in a helical pattern within the working chamber 28 toward the discharge outlet 16.

The partially reduced material then continues along the cutting plate 26 along the helical pathway in the working chamber 28 where comminution continues. Ultimately, the finished particles 17 are discharged from the working chamber 28 via the discharge outlet 16. One or more rows of hammers 22 may comprise leading edges 38 that are straight instead of angled to facilitate sweeping the particles 17 out of the discharge outlet 16 in a more efficient manner. Further, a section of the cutting plate 26 adjacent the discharge outlet 16 may be substantially smooth and free of cutting plate slots. This will eliminate the comminutive action of the working chamber 28 and allow the finished particles to be swept more efficiently out of the discharge chamber 16 by the rotating hammers 22.

The above specification describes certain preferred embodiments of this invention. This specification is in no way intended to limit the scope of the claims. Other modifications, alterations, or substitutions may now suggest themselves to those skilled in the art, all of which are within the spirit and scope of the present invention. It is therefore intended that the present invention be limited only by the scope of the attached claims below:

The invention claimed is:

1. A hammermill for comminuting material comprising:

a) a housing defining an inlet, an outlet, and a substantially cylindrical cutting plate disposed therebetween, the inlet communicating with the cylindrical cutting plate to receive material to be comminuted, the outlet communicating with the cylindrical cutting plate to discharge the comminuted material, the cylindrical cutting plate biased to move the material through along the cutting plate in a substantially helical profile from the inlet to the outlet;

b) a rotor rotatably mounted within the housing about an axis of rotation; and c) a plurality of hammers attached to the rotor, the hammers arranged in rows.

2. The hammermill of claim 1, further comprising the cutting plate having slots, wherein the slots are angled to direct the material across the working chamber and towards the outlet in a substantially helically profile.

3. The hammermill of claim 2, wherein the cutting plate slot pattern and cutting plate slot angle may be adjusted to achieve the desired balance between the required degree of comminution and efficiency of movement of material through the hammermill.

4. The hammermill of claim 2, further comprising a smooth cutting plate section disposed adjacent to the outlet to assist in the discharge of comminuted material.

5. The hammermill of claim 2, further comprising at least one row of hammers with straight edges to assist in the movement of material within the working chamber and in the discharge of comminuted material.

6. The hammermill of claim 2, further comprising the substantially helical profile having a pitch, the pitch being adjustable by adjusting the angle of the cutting plate slots.

7. The hammermill of claim 1, wherein the hammers comprise tips, the tips having leading edges, wherein the leading edges are angled to direct the material across the working chamber and towards the outlet in a substantially helical profile.

8. The hammermill of claim 7, further comprising the substantially helical profile having a pitch, the pitch being adjustable by adjusting the angle of the hammers' leading edge.

9. The hammermill of claim 7, wherein the angle of the leading edges of the hammers is of the same degree as the angle of the cutting plate slots, but in the opposite direction, to direct the material across the working chamber towards the outlet in a substantially helical profile.

10. The hammermill of claim 1, wherein the hammers further comprise tips with a leading edge, the leading edge being substantially straight and perpendicular to the axis of rotation of the rotor.

11. The hammermill of claim 1, further comprising the helical working chamber profile length being preferably 450 degrees.

12. The hammermill of claim 1, further comprising the helical working chamber profile length being between 270 degrees and 450 degrees.

13. The hammermill of claim 1, further comprising the helical working chamber profile length being greater than 450 degrees.

14. The hammermill of claim 1, further comprising the hammers having hammer tips that clear the cutting plate at an adjustable distance in order to achieve the desired balance between the required degree of comminution and efficiency of movement of material through the hammermill.

15. The hammermill of claim 14, further comprising the hammers having hammer tips with leading edges that clear the cutting plate at an adjustable distance, the leading edges being angled, wherein the cutting plate slot pattern and slot angle may be varied in conjunction with the adjustable distance of the hammer tip and the angle of the hammer tip leading edge to achieve the desired balance between the required degree of comminution and efficiency of movement of material through the hammermill.

16. The hammermill of claim 15, further comprising adjustability of rotational speed of the rotor to achieve the required degree of comminution.

17. A hammermill for comminuting material, comprising:

a) a housing defining an inlet, an outlet, and a substantially cylindrical cutting plate disposed therebetween, the inlet communicating with the cylindrical cutting plate to receive material to be comminuted, the outlet communicating with the cylindrical cutting plate to discharge the comminuted material, the cylindrical cutting plate comprising angled slots to move the material through along the cutting plate in a substantially helical profile from the inlet to the outlet, and wherein the helical profile travel length is between 270 degrees and 450 degrees;

b) a rotor rotatably mounted within the housing about an axis of rotation;

c) a plurality of hammers attached to the rotor, the hammers arranged in rows and comprise tips with leading edges, the tips clearing the cutting plate by an adjustable distance; and d) wherein the cutting plate slot pattern, angle and density may be adjusted and further wherein the rotational speed of the rotor may be adjusted to achieve the required degree of comminution.

* * * * *